United States Patent [19]

Ramberg

[11] 3,963,951

[45] June 15, 1976

[54] METAL HALIDE DISCHARGE LAMP HAVING A REFLECTIVE COATING

[75] Inventor: William I. Ramberg, Medford, Mass.

[73] Assignee: GTE Sylvania Incorporated, Danvers, Mass.

[22] Filed: June 20, 1975

[21] Appl. No.: 588,578

[52] U.S. Cl. ..... 313/44; 313/47

[51] Int. Cl.[2] ..... H01J 61/52

[58] Field of Search ..... 313/44, 47

[56] References Cited

UNITED STATES PATENTS 3,900,750 8/1975 Bamberg et al. ..... 313/44

*Primary Examiner*—R. V. Rolinec
*Assistant Examiner*—Darwin R. Hostetter
*Attorney, Agent, or Firm*—James Theodosopoulos

[57] ABSTRACT

The arc tube of a high intensity arc discharge lamp is horizontally operated and has a longitudinal stripe of heat reflecting coating along the lower surface of the arc tube in order to improve lamp efficiency.

3 Claims, 1 Drawing Figure

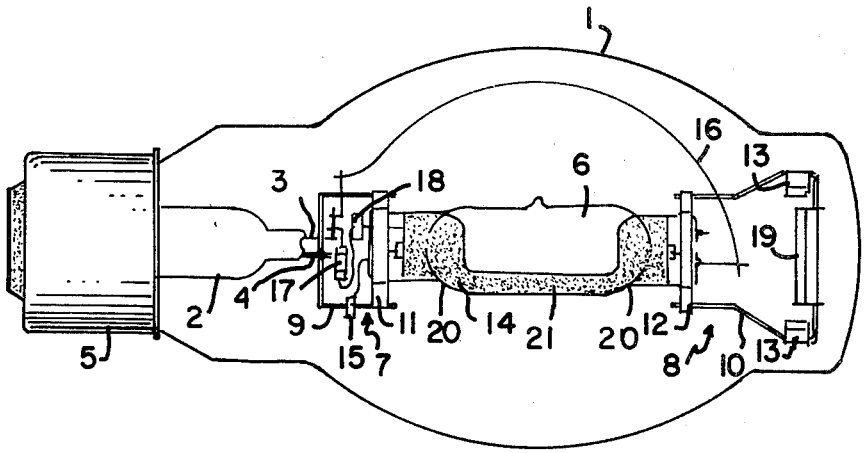
1
16
13
3
18
6
19
2
4
17
9
11
20
14
21
20
12
5
15
7
8
10
13

METAL HALIDE DISCHARGE LAMP HAVING A REFLECTIVE COATING

THE INVENTION

This invention concerns metal halide arc discharge lamps. Such lamps comprise an arc tube usually made of fused quartz or other high silica glass, having electrodes disposed therewithin and containing a fill including mercury, a metal halide and a starting gas. Examples of such lamps are shown in U.S. Pat. No. 3,761,758 and patents listed therein.

This invention is particularly concerned with arc tubes having heat reflective coatings. It is known to apply heat reflective coatings to arc tube ends. See, for example, U.S. Pat. Nos. 3,226,597 and 3,325,662 where it is disclosed that, in an uncoated arc tube, metal halides can condense on the envelope wall behind the electrodes and make the lamp ineffective; such condensation is prevented by reflective coatings at the ends of the arc tube.

In my invention, in addition to the coating at the arc tube ends, there is a longitudinal stripe of reflective coating on the lower wall of a horizontally operated arc tube. The result of such a stripe is an unexpected increase in lamp efficacy and maintenance.

The single FIGURE in the drawing is an elevational view of a metal halide arc discharge lamp in accordance with this invention; the view shows the arc tube in a horizontal position with the reflective stripe lowermost.

As shown in the drawing, one embodiment of an arc discharge lamp in accordance with this invention comprises an outer glass envelope or jacket 1. Jacket 1 is provided at its end with a sealed reentrant stem 2 through which extend relatively stiff lead-in wires 3 and 4 connected at their outer ends to the electrical contacts of a positioning-type base 5. Disposed within jacket 1 is an arc tube 6 having its ends 20 coated with a heat reflecting material 14 as in prior art arc tubes but having, in addition, a stripe 21 of heat reflective material, for example, zirconium dioxide, longitudinally extending along the bottom of arc tube 6 on the outer surface thereof. Coating 14 extends from the press seal portion of end 20 onto the bell shaped portion thereof at least about as far as the electrodes at each end of arc tube 6. In the drawing the electrodes are hidden by coating 14. Reflective stripe 21 and coating 14 preferably consist of the same heat reflective material, such as zirconium dioxide or calcium pyrophosphate and preferably stripe 21 extends from one coating 14 to the other. The relationship between arc tube 6 and base 5 is such that when base 5 is inserted into a suitable socket, the lamp will be in a substantially horizontal position, with stripe 21 lowermost.

Arc tube 6 is supported within jacket 1 by means of metal frames 7 and 8 at each end of arc tube 6. Metal frames 7 and 8 comprise rigid wires 9 and 10 respectively, to which are fastened clamps 11 and 12 each of which supports a pressed seal end of arc tube 6.

Metal frame 7 is supported by lead-in wire 4 to which it is welded. Metal frame 8 is supported at the other end by metal leaf springs 13 which press against the inner wall of envelope 1.

Electrical connection from lead-in wire 4 to the proximate main solid electrode (not shown; it is hidden by reflective coating 14) is through connective wire 15. Electrical connection from lead-in wire 3 to the other main electrode (also not shown) is through wire 16. Electrical connection from lead-in wire 3 to the starter electrode (not shown) is through resistor 17. Bimetal switch 18 shorts the starter electrode to the adjacent main electrode after lamp ignition occurs.

The atmosphere within jacket 1 is an inert gas, such as nitrogen; also disposed within jacket 1 is a getter 19, for gettering hydrogen, mounted on frame 8.

A comparison of 400 watt lamps having reflective coatings only at the ends of the arc tube, as in the prior art, was made with 400 watt lamps prepared in accordance with this invention, that is, having a longitudinal heat reflective stripe along the bottom of the arc tube. Arc tube parameters for the lamps were as follows: 20 mm inside diameter by 22 mm outside diameter; arc length of 45 mm; overall arc tube length of 89 mm; inside arc tube length of 64 mm; arc tube fill of 51 mg mercury, 20 mg sodium iodide, 5 mg mercuric iodide, 0.7 mg scandium and 35 torr argon.

As mentioned before, the prior art lamps had heat reflective coatings only at the arc tube ends, extending from the press seal region to the bell shaped ends of the arc tube, substantially as shown in the drawings of the previously mentioned U.S. Pat. Nos. 3,226,597 and 3,325,662. The lamps in accordance with this invention had the arc tube ends similarly coated but had, in addition, a reflective stripe 21 extending from the coating at one end along the bottom of the arc tube to the coating at the other end, substantially as shown in the drawing; in this example, stripe 21 was about 0.9 inches wide.

Initially, the lamps as per this invention yielded an average of 39,200 lumens as against 36,400 lumens for the prior art lamp, during normal 400 watt horizontal operation, an improvement of 7.7% in efficacy. After 100 hours of normal lamp operation, the respective figures were 39,600 lumens versus 33,000 lumens, an improvement of 20% in efficacy. After 500 hours operation, the respective figures were 35,000 lumens versus 29,500 lumens, an improvement of 18.5%. The respective maintenance figures, after 500 hours, were 89% versus 81%. Thus the lamps of this invention not only yield improved efficacy but they also provide better maintenance.

Another comparison was made on three groups of 400 watt lamps. Group 1 was the control, that is, the arc tubes had the usual prior art reflective coating at the ends. In Group 2, there was no reflective coating at the ends, but a reflective stripe extended across the bottom of the arc tube from press to press. Group 3 had both the end coatings and the stripe, as shown in the drawing. Both Group 2 and Group 3 had higher initial lumens per watt than Group 1, the respective figures being 101, 98 and 91. After 3000 hours operation, the respective figures were 67.5, 72.5 and 56. Thus Group 2 and 3 also had better maintenance than Group 1, the respective maintenance figures being 67%, 74% and 62%. Since Group 3 had better maintenance than Group 2, the preferred arc tube construction is that of Group 3.

An evaluation was made on the effect on lamp operation of the width of stripe 21 in the 400 watt arc tubes. During normal horizontal operation in an arc tube without a stripe, the axis temperature of the arc discharge was 5625° Kelvin, the sodium vapor pressure was 0.62 torr and the scandium vapor pressure was 5.6 $\times 10^{-2}$ torr. With a stripe about 0.3 inches wide, the axis temperature decreased to 5450°K and the sodium and scandium vapor pressures increased to 1.0 and 7.8

$\times 10^{-2}$ torr respectively. At stripe widths of 0.6, 0.9 and 1.4 inches, the axis temperature continued to decrease and the sodium and scandium vapor pressures continued to increase, although at reduced rates. The respective measurements at 1.4 inches were 5300°K, 1.7 torr and $11.3 \times 10^{-2}$ torr.

These results show that a stripe even as narrow as 0.3 inches significantly improved lamp operation because of the increased pressure of the more efficient light emitting metals.

Photographs of the arc discharge during lamp operation show that the stripe causes a reduction in mercury radiation from a hot core of the discharge and increases the intensity of the sodium radiation as well as improving the uniformity of the sodium radiation from one end of the discharge to the other.

I claim:

1. In a metal halide arc discharge lamp of the type having an arc tube having electrodes at each end thereof and containing a fill including mercury, metal halide and a starting gas, the improvement which comprises a stripe of heat reflecting material longitudinally extending across the bottom of the arc tube when the arc tube is in a horizontal position.

2. The lamp of claim 1 wherein the ends of said arc tube have a coating of heat reflective material thereon and said stripe extends from one coating to the other.

3. The lamp of claim 1 including means to position said stripe lowermost during normal operation of the arc tube in a horizontal position.

* * * * *

UNITED STATES PATENT AND TRADEMARK OFFICE

CERTIFICATE OF CORRECTION

PATENT NO. : 3,963,951

DATED : June 15, 1976

INVENTOR(S) : William I. Bamberg

It is certified that error appears in the above-identified patent and that said Letters Patent are hereby corrected as shown below:

Change the inventor's name from Ramberg to Bamberg.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*